US005937253A

United States Patent [19]

Shimazaki et al.

[11] Patent Number: 5,937,253

[45] Date of Patent: Aug. 10, 1999

[54] DEVELOPING APPARATUS AND L-SHAPED TONER REGULATING BLADE THEREFOR

[75] Inventors: Hiromitsu Shimazaki, Fukuoka-ken; Hironori Taguchi, Saiga-ken; Kazuhiko Noda, Chikushino; Akihiro Tsuru, Kitakyushu; Toshirou Kitahara, Kasuga; Keiichi Matsuzaki, Kasuga, all of Japan

[73] Assignee: Matsushita Electric Industrial Co., Ltd., Osaka, Japan

[21] Appl. No.: 09/013,929

[22] Filed: Jan. 27, 1998

[30] Foreign Application Priority Data

Mar. 27, 1997 [JP] Japan ..... 9-075416
Sep. 9, 1997 [JP] Japan ..... 9-243805

[51] Int. Cl.[6] ..... G03G 15/08

[52] U.S. Cl. ..... 399/284; 118/261

[58] Field of Search ..... 399/274, 284; 118/261

[56] References Cited

U.S. PATENT DOCUMENTS 5,338,895 8/1994 Ikegawa et al. ..... 399/284

FOREIGN PATENT DOCUMENTS 7-84452 3/1995 Japan .

*Primary Examiner*—William Royer

*Attorney, Agent, or Firm*—Stevens, Davis, Miller & Mosher, L.L.P.

[57] ABSTRACT

A developing apparatus includes a developing roller having a surface on which a layer of a non-magnetic single component developing agent (toner) is adapted to be formed, a toner supply roller held in contact with the developing roller so as to electrify the toner and also to supply the toner to the developing roller, and a toner regulating blade for regulating the toner on the developing roller so as to form a film of the toner thereon. The toner regulating blade is formed into a generally L-shape, and with a simple construction, the thickness of the toner layer, formed on the developing roller, can be stabilized, and also a torque of the developing roller can be reduced, and the degradation of a printed image is suppressed, thereby stabilizing the printed image.

6 Claims, 3 Drawing Sheets

DEVELOPING APPARATUS AND L-SHAPED TONER REGULATING BLADE THEREFOR

BACKGROUND OF THE INVENTION

1. Field of the Invention

This invention relates to a developing apparatus using a non-magnetic single component toner as a developing agent, which developing apparatus is used in an electrophotographic apparatus and an electrostatic recording apparatus.

2. Description of the Related Art

Electrophotographic apparatus of the type using dry toner have been the mainstream, and have been put into practical use as a copying machine, a laser beam printer, a plain paper facsimile machine and so on, and these electrophotographic apparatus have been markedly developed. Such an electrophotographic apparatus utilizes an electrophotographic process technology, and an electrostatic latent image, formed on a photosensitive member, is developed by toner particles.

The construction and operation of an electrophotographic apparatus will be described with reference to the drawings.

FIG. 3 shows the construction of the electrophotographic apparatus using a conventional developing apparatus of the non-magnetic single component contact developing type.

In FIG. 3, a photosensitive member 1 comprises a drum (base member) of metal (such as aluminum) having a photosensitive layer coated or formed on an outer peripheral surface thereof, this layer being a film of selenium (Se) or an organic photoconductor (hereinafter referred to as "OPC"). An electrifier 2 is provided in proximity to the photosensitive member 1 which is an electrostatic latent image carrier, and comprises an electrifying wire 2*a* (e.g. a tungsten wire), a shield plate 2*b* of metal, and a grid plate 2*c*. The electrifying wire 2*a* generates corona discharge, and uniformly electrifies the photosensitive member 1 through the grid plate 2*c*. An exposure light beam 4, emitted from an exposure optical system, is obtained by light intensity modulation and pulse width modulation of an image signal by a laser drive circuit (not shown), and forms an electrostatic latent image on the photosensitive member 1.

A toner 10 is stirred and fed by a toner stirring member 11 rotatably supported at opposite ends of a shaft on a developing hopper 9, and this toner 10 is supplied to a surface of a developing roller 5 serving as a toner carrier by a toner supply roller 6. The developing roller 5, as well as the toner supply roller 6, comprises a base member of metal (e.g. stainless steel) having a layer of an elastic material (such as urethane and silicone) formed on an outer peripheral surface thereof, and they are rotatably supported through metal shafts 5*a*, 6*a* on the opposite ends of the developing hopper 9.

The toner 10, supplied to the developing roller 5 from the toner supply roller 6, is frictionally electrified by a toner regulating blade (or developing blade) 7, and forms a film on the outer peripheral surface of the developing roller 5. Thereafter, the developing roller 5 is brought into contact with or close proximity to the photosensitive member 1, and the toner 10 is caused to transfer to the electrostatic latent image formed on the photosensitive member 1 by a developing bias voltage (Vb) applied from a developing bias supply source 12, thereby developing the electrostatic latent image.

The toner regulating blade 7 comprises a metal spring plate member (leaf spring member), and is formed by pressing into an integral construction having a curved distal end portion. A blade holder 8 fixes the toner regulating blade 7, and is secured to the developing hopper 9 by screws. Simultaneously with the rotation of the toner supply roller 6, the toner stirring member 11 revolves to prevent the agglomeration of the toner 10 contained in the developing hopper 9 and also to feed the toner 10 toward the toner supply roller 6.

Paper sheets 15, stored in a paper cassette 14, are fed one by one to feed rollers 17 from the paper cassette 14 by a paper feed roller 16 of a semicircular shape. The thus fed paper sheet (recording sheet) 15 is fed in a direction of arrow A by the feed rollers 17. A register roller 18 temporarily holds the paper sheet 15 in a stand-by condition so as to fit the paper sheet 15 to the toner image formed on the photosensitive member 1, and this register roller 18 is held in contact with a driven roller 19. A transfer roller 20 comprises a base member of metal (e.g. stainless steel) having a layer of an elastic material formed on an outer peripheral surface thereof, and this transfer roller 20 is rotatably supported in contact with the photosensitive member 1. When the toner image reaches an area of contact between the transfer roller 20 and the photosensitive member 1 in accordance with the rotation of the photosensitive member 1, the paper sheet 15 also reaches this contact area simultaneously with the toner image's arrival, and at this time a high voltage is applied from a transfer bias supply source 24 to a metal shaft 20*a* of the transfer roller 20 so as to impart to a reverse surface of the paper sheet 15 electric charges of a polarity reverse to that of the toner 10, thereby transferring the toner image, formed on the photosensitive member 1, onto the paper sheet 15. Then, the paper sheet 15 is fed left (in FIG. 3) to a fixing device 21 comprising a heat roller 22, having a heat source therein, and a pressing roller 23, and the paper sheet 15 is held between the rotating rollers 22 and 23, so that the transferred toner image on the paper sheet 15 is fixed by pressure and heat. The foregoing are the construction and operation of the conventional electrophotographic apparatus.

However, the above conventional developing apparatus of the non-magnetic single component developing type has problems that physical stresses, acting on the developing roller, are increased, so that scratches are formed on the surface of the developing roller, and that the degradation of the printed image, such as the formation of longitudinal streaks or stripes, is caused.

SUMMARY OF THE INVENTION

It is therefore an object of this invention to provide a developing apparatus which uses a non-magnetic single component toner, and has excellent durability with a simple construction, and suppresses the degradation of a printed image.

According to the present invention, there is provided a developing apparatus comprising a developing roller having a surface on which a layer of a toner, composed of a non-magnetic single component developing agent, is adapted to be formed; and a toner regulating blade (or developing blade) for regulating the toner on the developing roller so as to form a film of the toner thereon, the toner regulating blade being bent into a generally L-shape;

wherein an angle of a bent portion of the toner regulating blade is in the range of between 80° and 160°.

With this simple construction, the thickness of the toner layer, formed on the developing roller, can be stabilized and optimized, and besides a torque of the developing roller can be reduced, and the degradation of a printed image is suppressed, thereby stabilizing the printed image.

DESCRIPTION OF THE PREFERRED EMBODIMENT

A preferred embodiment of the present invention will now be described with reference to FIGS. 1 and 2.

Figure 1:
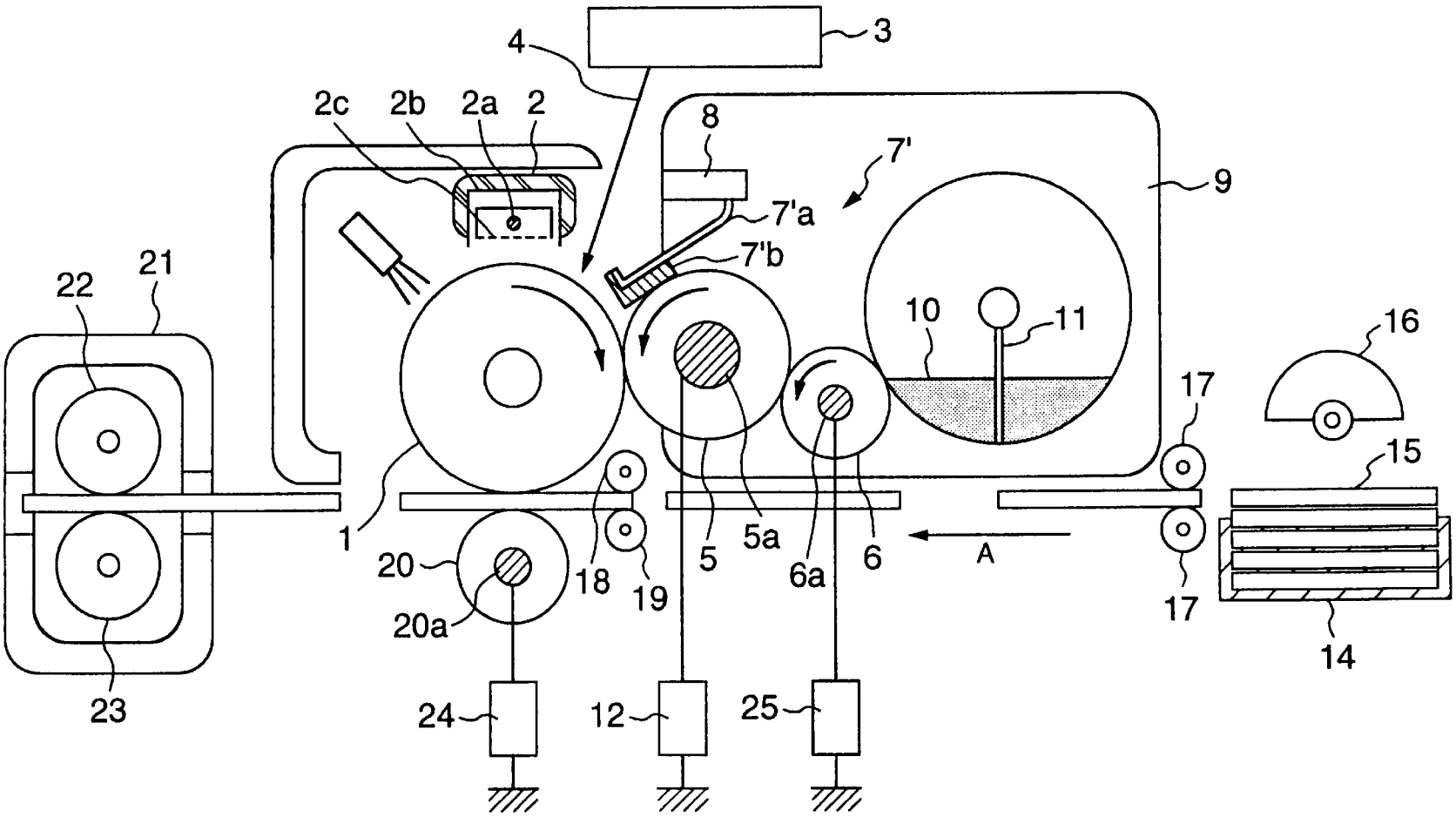
FIG. 1 is a view showing a construction of an electrophotographic apparatus employing a preferred embodiment of a developing apparatus according to the present invention.
Figure 2:
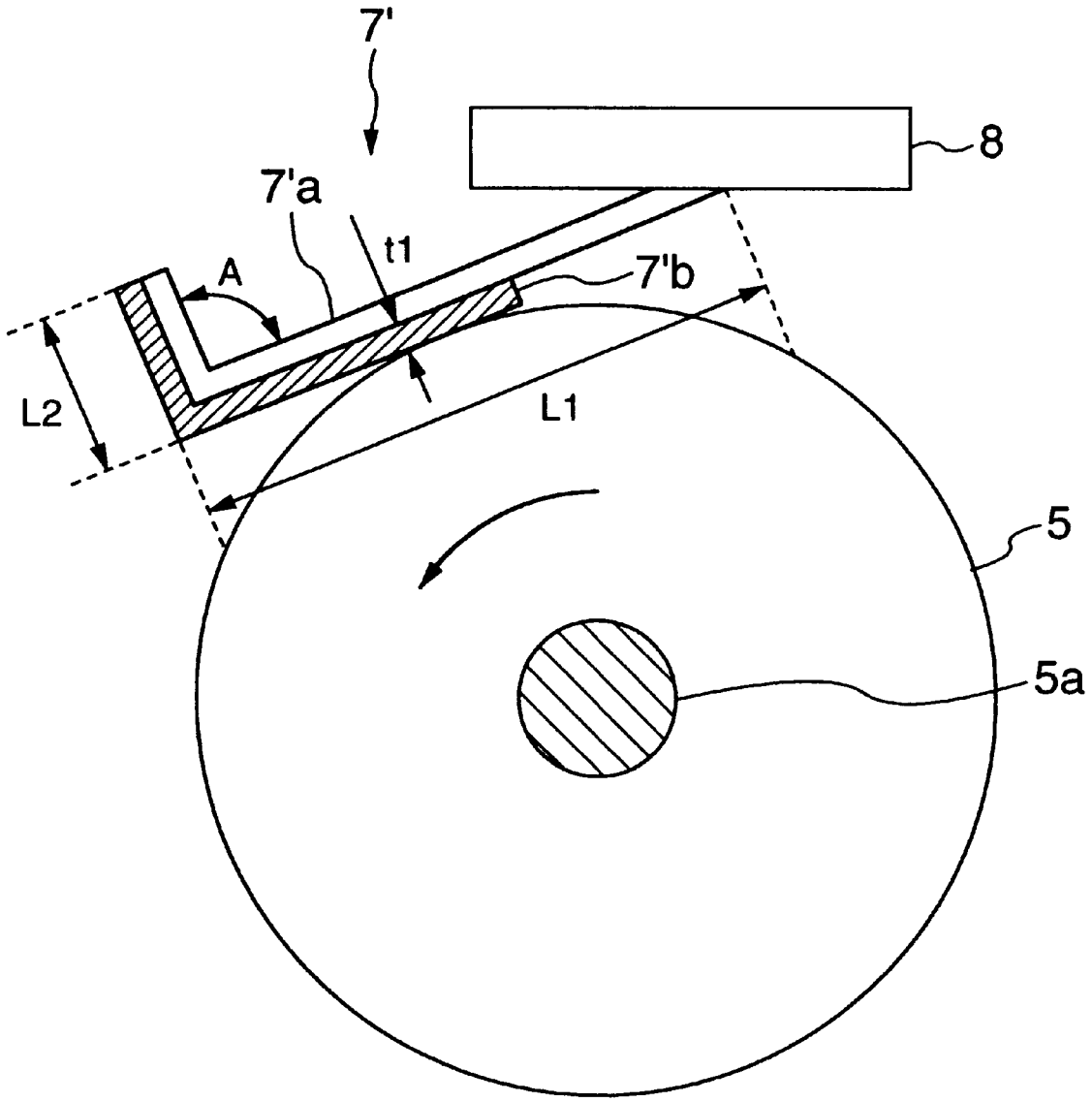
FIG. 2 is an enlarged view showing a toner regulating blade in the developing apparatus according to the above embodiment.
Figure 3:
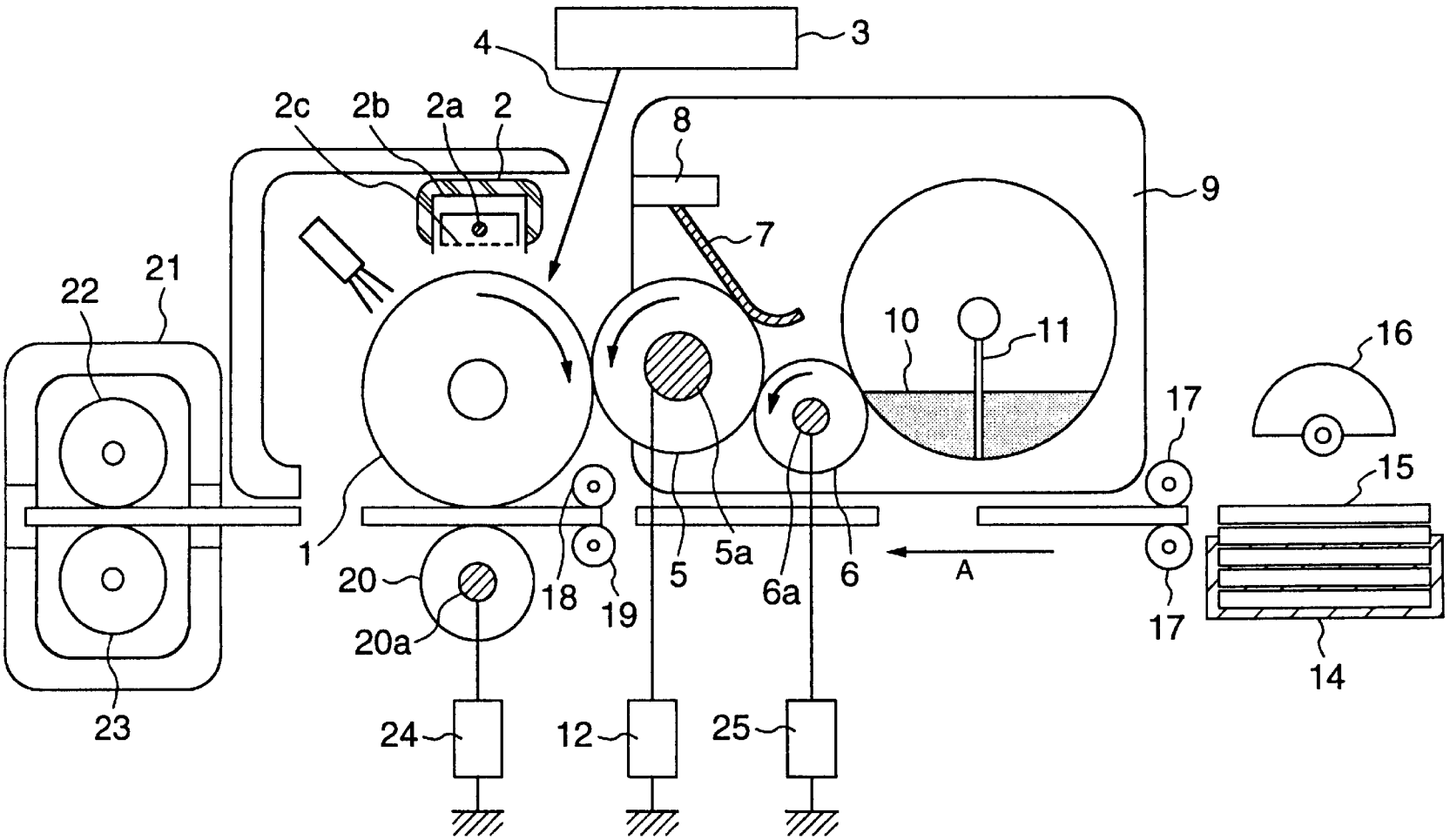
FIG.3 PRIOR ART
FIG. 3 is a view showing a construction of an electrophotographic apparatus using a conventional developing apparatus of the non-magnetic single component contact developing type.

FIG. 1 is a view showing a construction of an electrophotographic apparatus employing a preferred embodiment of a developing apparatus according to the invention, and FIG. 2 is an enlarged view showing a toner regulating blade in the developing apparatus according to the invention. Those portions identical to those of the conventional construction in FIG. 3 will be designated by identical reference numerals, respectively, and explanation thereof will be omitted.

In the drawings, the toner regulating blade 7' is formed or bent into a generally L-shape, and is held in contact with a developing roller 5 in a trailing direction. The toner regulating blade 7' comprises a resilient metal spring plate member 7'*a* of a generally L-shape made of stainless steel, phosphor bronze or other material, and a toner regulating member 7'*b* of a rubber-like elastic material integrally formed by coating on a distal end portion of the metal spring plate member 7'*a*. The toner regulating member 7'*b* comprises a layer made of one of urethane rubber, ethylene propylene (EPDM) rubber, a fluororesin and a mixture thereof. Reference character L1 represents a free length of the toner regulating blade 7', reference character L2 a length of a bent (outwardly-directed) distal end of the toner regulating blade 7', reference character A an edge angle of the toner regulating blade 7' (that is, the angle of the bent portion), and reference character t1 a thickness of the toner regulating member 7'*b*.

A photosensitive member 1 has a film of a negatively-chargeable OPC coated on an outer peripheral surface thereof, and can be uniformly charged to −700 V by an electrifier 2.

The developing roller 5 comprises a metal shaft 5*a* as a base member, and a layer of silicone resin formed on an outer peripheral surface of the metal shaft 5*a*. This silicone resin layer is adjusted into an electrically-conductive nature, and its resistivity is $10^6\Omega$. When the smoothness of the surface of the developing roller 5 is high, a film of a toner can be formed uniformly on this surface, and therefore preferably, the surface roughness of the developing roller 5 is not more than 7 $\mu$mRz. In this embodiment, the surface roughness of the developing roller 5 is 3 $\mu$mRz. A developing bias supply source 12 (which is a constant voltage source of −300 V) is connected to the metal shaft 5*a* of the developing roller 5.

A toner supply roller 6 is provided in contact with the developing roller 5 over a predetermined width, and the toner supply roller 6 rotates counterclockwise in the same direction as that of the developing roller 5. A bias supply source 25 is connected to a metal shaft 6*a* of the toner supply roller 6, and applies a bias voltage (Vsr), which is larger in absolute value than the above developing bias voltage (Vb), to the metal shaft 6*a*.

As shown in FIG. 2, the toner regulating blade 7', comprising the metal spring plate member 7'*a* and the toner regulating member 7'*b*, is fixedly secured at its proximal end to a blade holder 8 by screws, and is held at its contact portion in frictional contact with the developing roller 5.

The toner regulating member 7'*b* is pressed against the developing roller 5 with a line pressure of 80 to 100 g/cm, and forms a toner layer of 0.5 to 0.6 mg/cm$^2$ on the surface of the developing roller 5. In the non-magnetic single component contact developing type as in this embodiment, it is preferred that the amount of the toner layer on the developing roller 5 should be 0.3 to 0.6 mg/cm$^2$ in order to balance the density of the printed image.

The toner 10 is a non-magnetic single component toner, and is a negatively-chargeable toner comprising a polyester resin in which carbon, wax, a static control agent and so on are uniformly dispersed.

A transfer roller 20 comprises a metal shaft 20*a* having a layer of an electrically-conductive foamed material formed on an outer peripheral surface thereof, and the resistivity of the transfer roller is $10^7\Omega$. A transfer bias supply source 24 (which is a constant current source of 4 $\mu$A) is connected to the metal shaft 20*a*.

In this embodiment, although the photosensitive member 1 and the toner 10 are the negatively-chargeable photosensitive member and the negatively-chargeable toner, respectively, a positively-chargeable photosensitive member and a positively-chargeable toner can be used, in which case similar effects can be achieved. In this embodiment, although the toner regulating member 7'*b* is made of urethane rubber, EPDM rubber or a fluororesin, any other suitable rubber material, such as silicone rubber, acrylic rubber, butadiene rubber and CR rubber, may be used. However, it is desirable that the toner regulating member 7'*b* should have an excellent wear resistance in order to prevent the amount of adherence of the toner to the developing roller from being changed with time, and therefore urethane rubber, EPDM rubber and a fluororesin are preferred. Further, the developing roller 5 may be held in non-contact relation to the photosensitive member 1.

A printing operation of the electrophotographic apparatus, employing the above developing apparatus of the non-magnetic single component developing type, will now be described.

First, the photosensitive member 1 is uniformly charged to −700 V, and then is exposed by an exposure optical system 3, and then a surface potential of the exposed photosensitive member 1 is attenuated to −100 V, and a developing bias (Vb) is applied to the developing roller 5, thereby forming a toner image on the photosensitive member 1. A current of 4 $\mu$A is caused to flow from the transfer roller 20 to a paper sheet 15, thereby transferring the toner image onto the paper sheet 15, and then the toner image on the paper sheet 15 is fixed by a fixing process well known as an electrophotographic process.

Examples of the present invention will be described below.

EXAMPLES 1 to 4

In an electrophotographic apparatus using a developing apparatus of the above embodiment, a free length L1 (mm)

of a toner regulating blade 7', a length L2 (mm) of a bent distal end thereof and a thickness t1 (mm) of a toner regulating member 7'*b* were changed, and the difference between an initial torque of a developing roller 5 and the value of the torque of the developing roller 5, obtained after 12,000 sheets of paper were printed, a surface condition of the developing roller 5 (that is, whether or not any flaw was present on the developing roller 5) after the printing of 12,000 sheets, and the condition of the printed image were evaluated.

With respect to conditions of an electrophotographic process for the printing operation, a process speed was 76 mm/sec., and a peripheral speed of the developing roller 5 was 152 mm/sec., and a peripheral speed of a toner supply roller 6 was 106 mm/sec.

EXAMPLES 5 to 8

In an electrophotographic apparatus using a developing apparatus according to an embodiment of the invention, a positively-chargeable toner, having the same particle size as that of a negatively-chargeable toner used in Examples 1 to 4, was used, and a photosensitive member 1 was uniformly charged to +700 V by an electrifier 2, and was exposed by an exposure optical system 3, and a surface potential of the exposed photosensitive member 1 was attenuated to +120 V, and the same tests as in Examples 1 to 4 were conducted.

Comparative Examples 1 and 2

In an electrophotographic apparatus using a conventional developing apparatus (shown in FIG. 3) having a toner regulating blade 7 of metal, tests were conducted, using the same conditions of an electrophotographic process for the printing operation as in Examples 1 to 8.

The process conditions of Examples 1 to 8 and Comparative Examples 1 and 2 are shown in Table 1.

In Example 2, the toner regulating blade 7', having the free length L1 of 45.0 mm, the bent distal end length L2 of 4.5 mm and the thickness t1 of 0.05 mm, was used.

In Example 3, the toner regulating blade 7', having the free length L1 of 48 mm, the bent distal end length L2 of 9.5 mm and the thickness t1 of 0.20 mm, was used.

In Example 4, the toner regulating blade 7', having the free length L1 of 25.0 mm, the bent distal end length L2 of 1.5 mm and the thickness t1 of 0.002 mm, was used.

In Example 5, the toner regulating blade 7', having the free length L1 of 20.0 mm, the bent distal end length L2 of 3.0 mm and the thickness t1 of 1.00 mm, was used.

In Example 6, the toner regulating blade 7', having the free length L1 of 18.0 mm, the bent distal end length L2 of 3.5 mm and the thickness t1 of 0.03 mm, was used.

In Example 7, the toner regulating blade 7', having the free length L1 of 10.0 mm, the bent distal end length L2 of 1.8 mm and the thickness t1 of 0.05 mm, was used.

In Example 8, the toner regulating blade 7', having the free length L1 of 30.0 mm, the bent distal end length L2 of 2.5 mm and the thickness t1 of 0.05 mm, was used.

In Comparative Example 1, the toner regulating blade 7, having the free length L1 of 60 mm, the bent distal end length L2 of 1.5 mm and the thickness t1 of 0.01 mm, was used.

In Comparative Example 2, the toner regulating blade 7, having the free length L1 of 9.0 mm, the bent distal end length L2 of 1.5 mm and the thickness t1 of 0.02 mm, was used.

In Examples 1 to 8 and Comparative Examples 1 and 2, the initial density (image density) of the printed image and the difference between the initial density and the image density after the printing of 12,000 sheets, the initial torque of the developing roller 5 and the difference between the initial torque and the torque of the developing roller 5 after the printing of 12,000 sheets, and the surface condition of the developing roller 5 (that is, whether or not any flaw was present on the developing roller 5) after the printing of 12,000 sheets, were measured, and results thereof are shown in Table 2.

TABLE 1

| | Free length L1 (mm) | Length of bent distal end L2 (mm) | Rubber-like elastic material t1 (mm) | Surface roughness of rubber-like elastic material Rz (μm) | Resistivity of developing roller (Ω) | Rubber hardness of developing roller/ Asker-C(°)) | NIP width (developing roller/ supply roller) (mm) | Developing bias Vb toner supply bias Vsr (V) |
|---|---|---|---|---|---|---|---|---|
| Example 1 | 12.0 | 1.5 | 0.02 | 3.5 | $8 \times 10^7$ | 35 | 0.5 | −300/−450 |
| Example 2 | 45.0 | 4.5 | 0.05 | 5.5 | $3 \times 10^8$ | 45 | 0.8 | −200/−380 |
| Example 3 | 48.0 | 9.5 | 0.20 | 6.0 | $2 \times 10^7$ | 40 | 0.7 | −300/−450 |
| Example 4 | 25.0 | 1.5 | 0.002 | 9.3 | $8 \times 10^5$ | 35 | 0.8 | −350/−450 |
| Example 5 | 20.0 | 3.0 | 1.00 | 5.5 | $6 \times 10^3$ | 60 | 0.8 | +350/+550 |
| Example 6 | 18.0 | 3.5 | 0.03 | 1.2 | $3 \times 10^5$ | 70 | 1.1 | +350/+500 |
| Example 7 | 10.0 | 1.8 | 0.05 | 3.8 | $3 \times 10^8$ | 35 | 0.5 | +350/+550 |
| Example 8 | 30.0 | 2.5 | 0.05 | 8.5 | $2 \times 10^9$ | 60 | 0.7 | +300/+450 |
| Comparative Example 1 | 60.0 | 1.5 | 0.01 | 3.5 | $7 \times 10^{10}$ | 40 | 0.8 | −350/−400 |
| Comparative Example 2 | 9.0 | 1.5 | 0.02 | 3.5 | $6 \times 10^2$ | 60 | 1.2 | +300/+350 |

It will be readily appreciated from this Table 1 that in Example 1, the toner regulating blade 7', having the free length L1 of 12.0 mm, the bent distal end length L2 of 1.5 mm and the (toner regulating member) thickness t1 of 0.02 mm, was used.

TABLE 2

| | Macbeth density (Initial density) | Macbeth density Δ (Difference Δ between initial density and density after printing of 12,000 sheets) | Initial torque (kg · cm)/Difference between initial torque and resultant torque (kg · cm) | Flaw on developing roller (after printing of 12,000 sheets) |
|---|---|---|---|---|
| Example 1 | 1.50 | 0.1 | 1.5<br>0.4 | None |
| Example 2 | 1.55 | 0.1 | 1.5<br>0.1 | None |
| Example 3 | 1.52 | 0.1 | 1.6<br>0.2 | None |
| Example 4 | 1.60 | 0.1 | 1.6<br>0.4 | None |
| Example 5 | 1.55 | 0.1 | 1.5<br>0.3 | None |
| Example 6 | 1.50 | 0.1 | 1.6<br>0.3 | None |
| Example 7 | 1.55 | 0.1 | 1.4<br>0.5 | None |
| Example 8 | 1.55 | 0.1 | 1.3<br>0.6 | None |
| Comparative Example 1 | 1.50 | 0.5 | 2.1<br>2.0 | Developed (Longitudinal streaks on printed image) |
| Comparative Example 2 | 1.53 | 0.5 | 3.5<br>1.2 | Developed (Longitudinal streaks on printed image) |

As is clear from Table 2, in Examples 1 to 4, the value of the initial torque of the developing roller 5, as well as the difference between the initial torque and the value of the torque after the printing operation, is smaller as compared with Comparative Examples 1 and 2 using the conventional developing apparatus, and also the torque of the developing roller 5 does not increase in accordance with the running of the developing roller 5, and it has been found that stresses, acting on the developing roller 5, are reduced.

In Examples 5 to 8 in which the positively-chargeable toner is used, also, it has been found that stresses, acting on the developing roller 5, are reduced as in Examples 1 to 4.

In Examples 1 to 4, the difference between the initial density and the value of the density after the printing of 12,000 sheets is smaller as compared with Comparative Examples 1 and 2, and it has been found that variations in the image density can be effectively suppressed.

In Examples 5 to 8 in which the positively-chargeable toner is used, also, it has been found that variations in the image density can be effectively suppressed as in Examples 1 to 4.

In Examples 1 to 4, no flaws developed on the developing roller 5 as compared with Comparative Examples 1 and 2 using the conventional developing apparatus, and it has been found that the durability of the developing roller 5 is enhanced.

In Examples 5 to 8 in which the positively-chargeable toner is used, also, no flaws developed on the developing roller 5 as in Examples 1 to 4, and it has been found that the durability of the developing roller 5 is enhanced.

As described above, in this embodiment, when the toner regulating member 7'*b* of an rubber-like elastic material in the generally L-shaped toner regulating blade 7' was made of urethane, the development of a flaw on the developing roller 5 was effectively suppressed. Also, when the toner regulating member 7'*b* was made of either of ethylene propylene rubber (EPDM) and a fluororesin, similar effects were obtained.

When the thickness of the toner regulating member 7'*b* was less than 1 μm, longitudinal streaks were formed on the printed image after the printing of 12,000 sheets. When the distal end of the toner regulating blade 7' was not bent, the thickness of the toner layer increased as the printing operation proceeded, and it has been found that the frictional electrification between the developing roller 5 and the toner regulating blade 7' became uneven, so that the uniformity of the printed image was degraded.

When the angle of the bent portion of the toner regulating blade 7' (bent into a generally L-shape), which regulates the toner (non-magnetic single component developing agent) so as to form a film of the toner on the surface of the developing roller 5, is in the range of between 80° and 160°, it has been found that the thickness of the toner layer, formed on the surface of the developing roller 5, is stabilized and optimized, and that the torque of the developing roller 5 is reduced. If this edge angle is less than 80°, the thickness of the toner layer tends to become unstable, and if the edge angle is more than 160°, the adherence of the toner is liable to occur, and both are not desirable.

When the free length of the toner regulating blade 7' (bent into a generally L-shape), which regulates the toner (non-magnetic single component developing agent) so as to form a film of the toner on the surface of the developing roller 5, is in the range of between 10 mm and 50 mm, it has been found that the amount of electrification of the toner layer, formed on the surface of the developing roller 5, is stabilized. If this free length is less than 10 mm, the amount of electrification of the toner tends to be reduced, and if this free length is more than 50 mm, the thickness of the toner layer tends to become unstable, and both are not desirable.

When the length of the bent distal end of the toner regulating blade 7' (bent into a generally L-shape), which regulates the toner (non-magnetic single component developing agent) so as to form a film of the toner on the surface of the developing roller 5, is in the range of between 1 mm and 10 mm, it has been found that the fluidity of the toner is prevented from being lowered. If the length of the bent distal end is less than 1 mm, stresses, acting on the developing roller 5, tend to increase, and if this length is more than 10 mm, the printed image tends to be degraded, and both are not desirable.

When the toner regulating member 7'*b* (of a rubber-like elastic material) is formed in a layer on that surface of the toner regulating blade 7' (bent into a generally L-shape) disposed in contact with the developing roller 5, it has been found that the amount of electrification of the toner layer, formed on the surface of the developing roller 5, is stabilized. The layer of toner regulating member 7'*b* is provided by coating, bonding by an adhesive, or other means.

When the toner regulating member 7'*b* (of a rubber elastic material) is made of a urethane resin, ethylene propylene rubber, a fluororesin or a mixture thereof, it has been found that the wear resistance of the developing roller 5 is enhanced. PTFE, PFA, or other suitable fluorine compound is used as this fluororesin.

When the thickness of the toner regulating member 7'*b* (of a rubber-like elastic material) is in the range of between 1 $\mu$m and 2,000 $\mu$m, it has been found that the amount of electrification of the toner layer, formed on the surface of the developing roller 5, is stabilized, so that the printed image is free from fogging, and has a good quality. If the thickness of the toner regulating member 7'*b* is less than 1 $\mu$m, stresses, acting on the developing roller 5, tend to increase, and if this thickness is more than 2,000 $\mu$m, the toner layer tends to become unstable, and both are undesirable.

When the resistivity of the toner regulating member 7'*b* (of a rubber-like elastic material) is in the range of between $10^3\Omega\cdot$cm and $\mathbf{10}^9\Omega\cdot$cm, it has been found that the amount of electrification of the toner layer, formed on the surface of the developing roller 5, is stabilized. If the resistivity of the toner regulating member 7'*b* is less than $\mathbf{10}^3\Omega\cdot$cm, the amount of electrification of the toner layer tends to decrease, and if this resistivity is more than $10^9\Omega\cdot$cm, the amount of electrification of the toner layer also tends to decrease, and both are not desirable.

When the surface roughness of the toner regulating member 7'*b* (of a rubber-like elastic material) is in the range of between 0.1 $\mu$mRz and 10 $\mu$mRz, it has been found that the thickness of the toner layer, formed on the surface of the developing roller 5, and the amount of electrification of the toner layer, are stabilized. If the surface roughness of the toner regulating member 7'*b* is less than 0.1 $\mu$mRz, the thickness of the toner layer tends to decrease, and if this surface roughness is more than 10 $\mu$mRz, the thickness of the toner layer tends to increase, and both are not desirable.

What is claimed is:

1. A developing apparatus comprising a developing roller having a surface on which a layer of a toner, comprising a non-magnetic single component developing agent, is adapted to be formed; and a toner regulating blade for regulating the toner on said developing roller so as to form a film of the toner thereon, said toner regulating blade being bent into a generally L-shape;

wherein a free length of said toner regulating blade is in the range of between 10 mm and 50 mm.

2. A developing apparatus comprising a developing roller having a surface on which a layer of a toner, comprising a non-magnetic single component developing agent, is adapted to be formed; and a toner regulating blade for regulating the toner on said developing roller so as to form a film of the toner thereon, said toner regulating blade comprising a metal member and being bent into a generally L-shape;

wherein an angle of a bent portion of said toner regulating blade is in the range of between 80° and 160°, and in which a layer of a rubber-like elastic material is formed on that surface of said toner regulating blade disposed in contact with said developing roller.

3. A developing apparatus according to claim 2, in which said rubber-like elastic material is made of one of urethane rubber, ethylene propylene rubber, a fluororesin and a mixture thereof.

4. A developing apparatus according to claim 2, in which a resistivity of said rubber-like elastic material is in the range of between $10^3\Omega\cdot$cm and $10^9\Omega\cdot$cm.

5. A developing apparatus according to claim 2, in which surface roughness of said rubber-like elastic material is in the range of between 0.1 $\mu$mRz and 10 $\mu$mRz.

6. A developing apparatus comprising a developing roller having a surface on which a layer of a toner, comprising a non-magnetic single component developing agent, is adapted to be formed; and a toner regulating blade for regulating the toner on said developing roller so as to form a film of the toner thereon, said toner regulating blade being bent into a generally L-shape;

wherein an angle of a bent portion of said toner regulating blade is in the range of between 80° and 160°, and a free length of said toner regulating blade is in the range of between 10 mm and 50 mm, and a length of a bent distal end of said toner regulating blade is in the range of between 1 mm and 10 mm.

* * * * *